United States Patent [19]

Snavely et al.

[11] 4,173,778

[45] Nov. 6, 1979

[54] LIGHTING FIXTURES AND GLASS ENCLOSURE HAVING HIGH ANGLE ANTI-REFLECTION COATING

[75] Inventors: Carol J. Snavely, Santa Rosa, Calif.; Ian Lewin, Scottsdale, Ariz.; Edward A. Small, Jr., Santa Rosa, Calif.

[73] Assignee: Optical Coating Laboratory, Inc., Santa Rosa, Calif.

[21] Appl. No.: 879,734

[22] Filed: Feb. 21, 1978

Related U.S. Application Data

[63] Continuation of Ser. No. 709,413, Jul. 28, 1976, abandoned.

[51] Int. Cl.[2] ..... F21V 7/00

[52] U.S. Cl. ..... 362/297; 362/305; 362/350

[58] Field of Search ..... 362/297, 303-307, 362/349, 350, 337

[56] References Cited

U.S. PATENT DOCUMENTS

| | | | |
|---|---|---|---|
| 1,793,661 | 2/1931 | Wood | 362/350 |
| 2,670,652 | 3/1954 | Sherman | 362/349 |
| 3,763,369 | 10/1973 | Lewin | 362/337 X |
| 3,836,767 | 9/1974 | Lasker | 362/303 X |
| 3,941,459 | 3/1976 | McFarland et al. | 362/297 X |

*Primary Examiner*—Peter A. Nelson

*Attorney, Agent, or Firm*—Harold C. Hohbach

[57] ABSTRACT

Lighting fixture having a housing with an open side. A lamp is mounted in the housing that is capable of producing light rays which pass through the open side of the housing. A protective covering of glass is carried by the housing and encloses the open side. The protective covering of glass is provided with a surface which has a high angle anti-reflection coating disposed on the surface.

22 Claims, 17 Drawing Figures

RESULTS OF CERTIFIED TEST ON 18" X 18" AREA LIGHT USING 400W HIGH PRESSURE SODIUM LAMP RATED 50,000 LUMENS

| CO-EFFICIENT OF UTILIZATION (%) | | CANDLE POWER 0° | MAXIMUM CANDLE POWER VERTICAL ANGLE 67.5° |
|---|---|---|---|
| UNCOATED | 57.7 | 6,499 | 26,054 |
| COATED | 62.3 | 6,541 | 31,334 |
| INCREASE | 8.0 % | 0.6 % | 20.3 % |

LIGHTING FIXTURES AND GLASS ENCLOSURE HAVING HIGH ANGLE ANTI-REFLECTION COATING

This is a continuation of application Ser. No. 709,413 filed July 28, 1976, and now abandoned.

BACKGROUND OF THE INVENTION

Lighting fixtures and luminaires of many types have heretofore been provided which have housings which are open on one side and which have glass coverings for the open side. Because of high energy costs and also because of increased costs for lighting fixtures, poles for mounting the same and the like, there is a great need for increasing the efficiency of the lighting fixtures. It has been known that glass when used as a protective covering has a high reflection of light at relatively wide angles. There is, therefore, a great need to increase the efficiency of the lighting fixtures, particularly at high angles.

SUMMARY OF THE INVENTION AND OBJECTS

In general, the lighting fixture consists of a housing having an open side. A lamp is mounted in the housing and is capable of producing light rays which pass through the open side of the housing. A protective covering of glass is carried by the housing and encloses the open side. The protective covering has first and second surfaces. A high angle anti-reflection coating is provided on at least one of these surfaces and preferably on both surfaces to increase the efficiency of the light fixture.

In general, it is an object of the present invention to provide a lighting fixture which has an increased light output.

Another object of the present invention is to provide a lighting fixture of the above character which has increased output particularly at high angles.

Another object of the present invention is to provide a lighting fixture of the above character and a glass enclosue therefor in which the glass enclosure has a high angle anti-reflection coating thereon.

Another object of the present invention is to provide a lighting fixture of the above character and a glass enclosure therefor in which the anti reflection coating increases the transmission at low angles and decreases the transmission at high angles.

Additional objects and features of the invention will appear from the following description in which the preferred embodiments have been set forth in conjunction with the accompanying drawings.

BRIEF DESCRIPTION OF THE PREFERRED EMBODIMENTS

Figure 1:
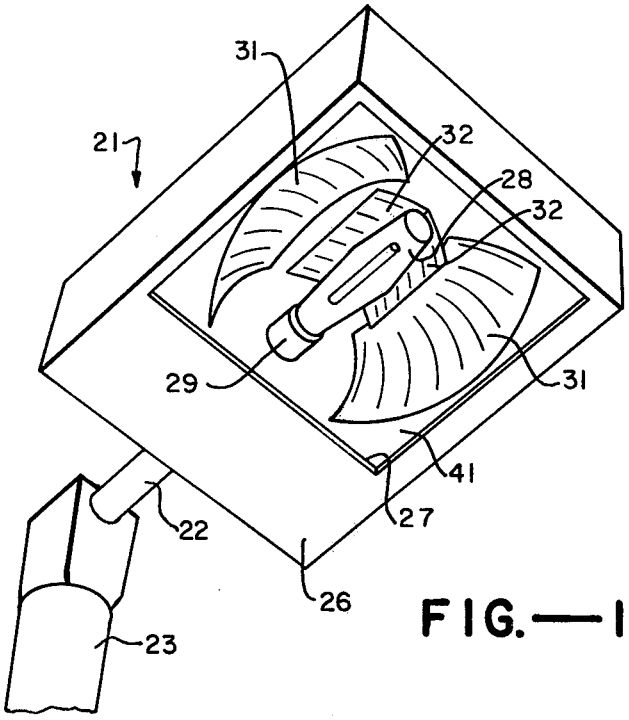
FIG. 1 is an isometric view of a lighting fixture incorporating the present invention.
Figure 2:
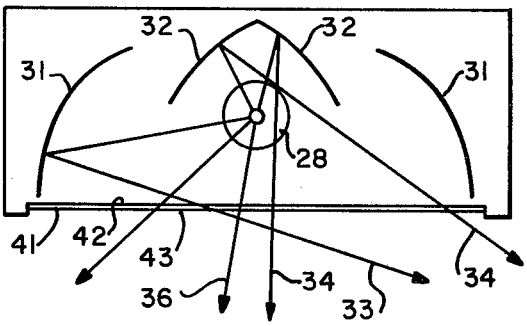
FIG. 2 is a diagrammatic illustration of the light fixture shown in FIG. 1.

In FIG. 1, there is shown a lighting fixture or luminaire which incorporates the present invention. The basic construction of the lighting fixture 21 is conventional and thus will not be described in detail. As shown in FIG. 1, the lighting fixture 21 is carried by a horizontally extending rod 22. The rod 22 is mounted upon a pole or standard 23 such as is commonly used in street or roadway lighting.

The lighting fixture 21 consists of a rectangular box-shaped housing 26 which is provided with a large downwardly facing rectangular opening 27. A light source is provided within the housing for directing rays of light through the opening 27 and consists of a lamp 28 mounted in a socket 29. The socket 29 is mounted in the housing 26 in a conventional manner. The lamp 28 can be of any conventional type. In the case of roadway lighting, the lamp 28 is conventionally of a high intensity discharge type (HID) and typically uses a metal halide or high pressure sodium light source. Occasionally, a mercury arc lamp may be utilized. As shown in the drawing, the lamp 28 is a high pressure sodium light.

Reflective means is conventionally provided within the housing 26 to reflect additional light from the lamp 28 through the opening 27. As shown in FIG. 1, this reflective means consists of two pairs or sets of reflectors 31 and 32. The reflectors 31 are side reflectors and are used for reflecting light out of the opening and reflect the light at a high angle as indicated by the rays 33. The reflectors 31 can have any desired shape. Typically, they are curved and are often parabolic or hyperbolic to obtain the best light distribution. The reflectors 32 are conventionally smaller reflectors and are positioned over the lamp so that the rays emanating normally from the lamp in an upward direction are reflected down through the opening 27 in the housing with some of the reflected light rays passing through the lamp 28. These light rays pass out of the housing 26 at a relatively low angle as indicated by the rays 34. In addition to the rays which are reflected by the reflectors 31 and 32 there are also direct rays 36 which pass downwardly down through the opening 27.

An enclosure in the form of a glass plate 41 is conventionally provided to close the opening 27 and is mounted in the housing 26 in such a way so that it forms a sealed enclosure for the lamp 28. Typically, the glass plate 41 is tempered glass so that it cannot be readily broken and also serves to protect the lamp 28 from rocks and the like. The glass enclosure 41 is in the form of a flat plate as for example tempered soda lime glass having a thickness ranging from ⅛ to 3/16 of an inch. The glass typically has an index of refraction of 1.52. The glass plate 41 is provided with spaced parallel planar surfaces 42 and 43 with 42 being the inside surface and 43 being the outside surface.

Figure 3:
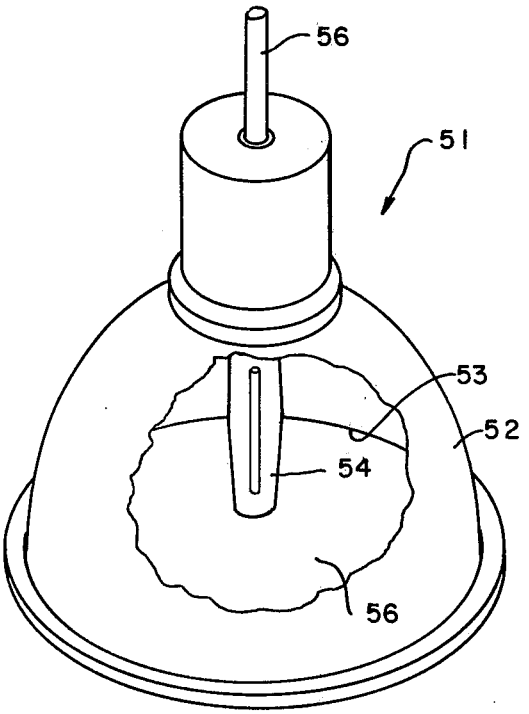
FIG. 3 is an isometric view with certain portions broken away of another type of lighting fixture incorporating the present invention.
Figure 4:
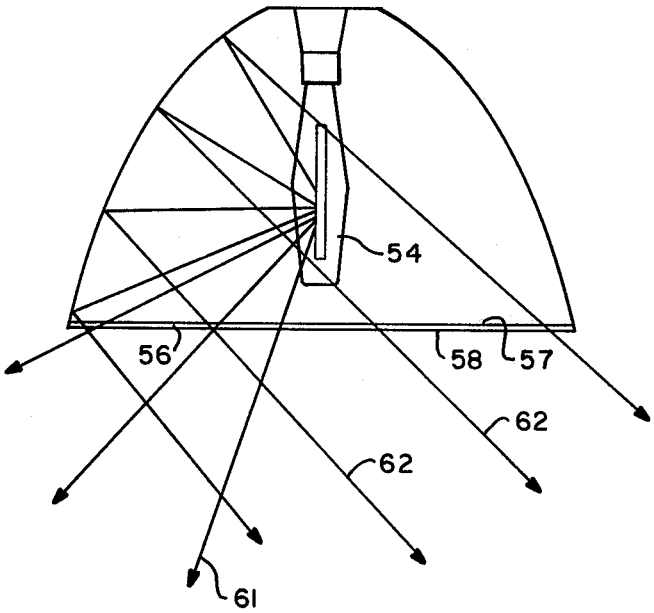
FIG. 4 is a diagrammatic illustration of the lighting fixture shown in FIG. 3.
Figure 5:
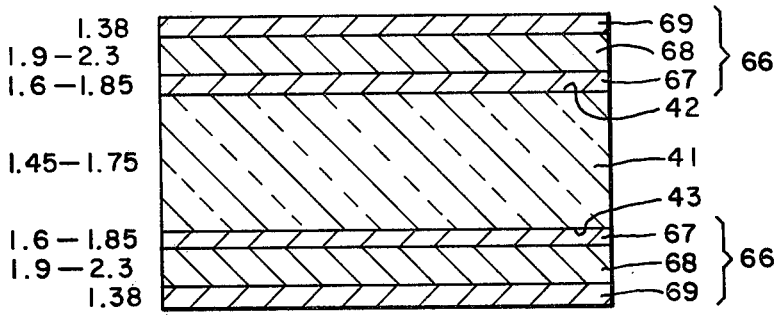
FIG. 5 is a partial cross-sectional view of a glass enclosure utilizing a high angle three-layer anti-reflection coating.

In FIG. 3, there is shown another lighting fixture 51 of an industrial type. As shown therein, it includes a generally hemispherical housing 52 which also has a circular open lower end which defines a downwardly facing opening 53. A lamp 54 of the same type as lamp 28 shown in FIG. 1 is mounted in a socket (not shown) provided in the housing 52. The socket 52 is connected by a power cord 55 to a source of electrical power. A glass enclosure 56 is provided for closing the opening 53. As shown, particularly in FIG. 4, the glass enclosure 56 is in the form of a plate which has spaced parallel planar inner and outer surfaces 57 and 58. The housing 52 serves as a reflector and in this type of lighting fixture provides a relatively uniform distribution of light below the housing 52 up to an angle of approximately 70°. As can be seen from FIG. 4, there are direct rays 61 emanating from the lamp 54 and in addition, there are reflected rays 62.

In accordance with the present invention, both of the surfaces 57 and 58 of the glass enclosure 56 and similarly both of the surfaces 42 and 43 of the glass plate 41 are coated with a high angle anti-reflection coating 66 on each surface. Each of the coatings 66 is a three-layer anti-reflection coating of the general type disclosed in Thelen U.S. Pat. No. 3,185,020. Each of the coatings 66 consists of first, second and third-layers 67, 68, and 69 counting from the surface of the substrate. The first-layer is formed of a material having an index of refraction of 1.62 to 1.85. One material found to be satisfactory is aluminum oxide ($Al_2O_3$) having an index of refraction of 1.65. Other materials which can be utilized if desired are cerium oxide and lanthanum oxide. The second layer is formed of a material which has an index of refraction in the range of 1.9 to 2.3. One material found to be satisfactory is a mixed oxide of metals selected from the group consisting of thorium, titanium, copper, tin, chromium, magnesium, iron, nickel, cobalt, cerium, praseodymium, neodymium, samarium and didymium having an index of refraction of 2.06. Another material which can be utilized is zirconium oxide. For the third layer magnesium fluoride can be utilized having an index of refraction of 1.38.

In the Thelen U.S. Pat. No. 3,185,020 the three layers are characterized as having a thickness of ¼, ½ and ¼ respectively with a design wave-length of 550 nanometers which is the center of the visible region.

In order to obtain greater efficiency of the coating at high angles, the layer thicknesses have been modified to make the coating more efficient at high angles while still retaining good efficiency at low angles.

In order to ascertain the modifications to be made the internal angle of the ray in each layer was calculated using Snell's law starting with an angle of incidence of 75°. New film thicknesses were calculated following the phase thickness formula derived from Maxwell's equations to establish high angle thickness = Normal Angle Thickness/Cos $\Theta$ where $\Theta$ is the angle in the layer, the complete design is then optimized by using the least squares method to bring the design as close to optimum as possible.

In making these layer thickness changes, it was found that a specific design utilizing the aluminum oxide, "Ida" and magnesium fluoride for the three materials for the three-layers, the aluminum oxide layer 67 had a quarter wave optical thickness of 1650 angstroms. The said mixed oxide layer 68 had a quarter wave optical thickness of 11,810 angstroms and the magnesium fluoride layer 69 had a quarter wave optical thickness of 7300 angstroms. These particular layer thicknesses for these particular materials can be modified as much as plus or minus 15% and still make it possible to achieve an effective design.

In two other specific designs on three-layer anti-reflection coatings having high efficiency, the following materials and thicknesses were used. In the first of the two designs, the layer 67 was formed of aluminum oxide ($Al_2O_3$) having an index of refraction of 1.64 and having a quarter wave optical thickness of 6,430 angstroms. The second-layer 68 was formed of titanium oxide ($TiO_2$) having an index of refraction of 2.32 and having a quarter optical thickness of 11,440 angstroms. The third-layer 69 was formed of magnesium fluoride ($MgF_2$) having an index of refraction of 1.38 and having a quarter wave optical thickness of 7,280 angstroms. In the second of the two additional designs, the first-layer 67 was again formed of aluminum oxide having an index of refraction of 1.64 and having a quarter wave optical thickness of 6,427 angstroms. The second-layer 68 was formed of zirconium dioxide ($ZrO_2$) having an index of refraction of 2.00 and having a quarter wave optical thickness of 11,877 angstroms. The third-layer 69 was formed of magnesium fluoride having an index of refraction of 1.38 and having a quarter wave optical thickness of 7,280 angstroms.

The same three-layer coating 66 which is provided on the glass enclosure plate 41 can also be placed upon the glass enclosure 56 for the lighting fixture 51.

Figure 6:
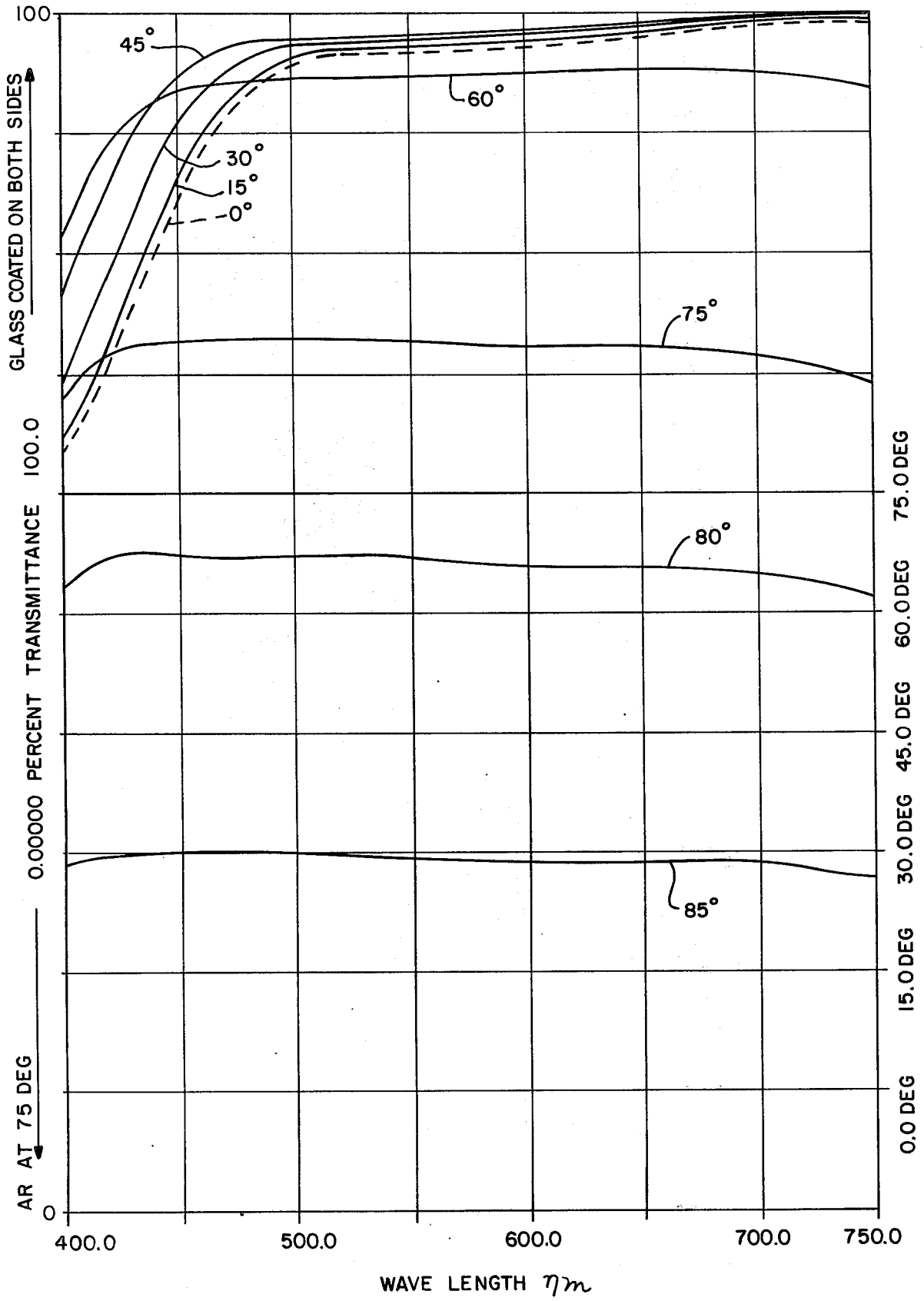
FIG. 6 is a graph showing transmission versus wave-length at different angles for a three-layer high angle anti-reflection coating on two surfaces of the glass enclosure shown in FIG. 5.

FIG. 6 shows the transmission versus wave length of a plate of glass carrying a three-layer coating 66 on each of the two planar parallel sides. As can be seen from FIG. 6, a plurality of curves are shown therein which show the transmission of the coating at various angles. The curves for the respective angles are identified with the angle. As can be seen from FIG. 6, as the angle increases, the transmission decreases.

Figure 7:
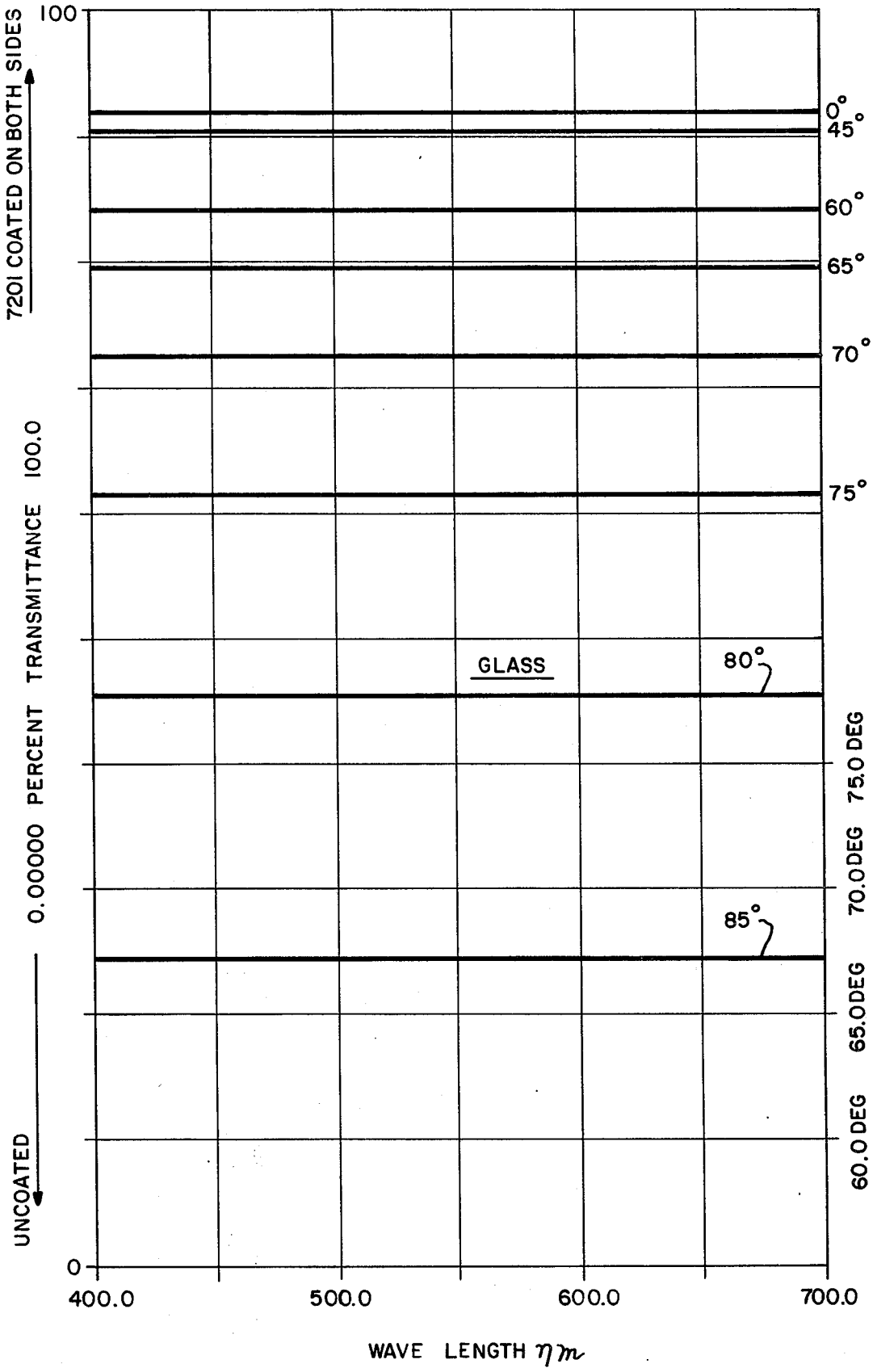
FIG. 7 is a graph showing transmission with wave-length of uncoated glass at different angles.

In FIG. 7, there is shown a family of curves similar as shown in FIG. 6 but for uncoated glass. As can be seen from FIG. 7, the curves therein are labeled for the various angles. For example, at 0° angle of incidence, the transmission through glass is approximately 92% or in other words the reflectivity is approximately 8% which means that each surface of the glass is reflecting approximately 4%. As can be seen, as the angle of incidence increases, the reflectivity from the glass increases until at very high angles close to 90% there is almost total reflectivity and substantially no transmission. By examining FIG. 7, it can be seen that the transmission drops very rapidly as soon as the angle of incidence approaches within the vicinity of 50°. At an angle of incidence of 85°, the transmission is only approximately 24½%. Thus it can be seen that there is a great need to increase the transmission of light which impinges upon the glass at high angles of incidence. The amount of improvement which can be obtained with the three-layer coating 66 provided on both surfaces can be seen by comparing the curves in FIGS. 6 and 7. By way of example, at 75° with uncoated glass, the transmission is down to approximately 61½% whereas when both surfaces of the glass are coated as can been seen from FIG. 6 the transmission is well over 70% so there is an improvement of at least 10%. At 80°, the transmission in FIG. 7 is approximately 45%, whereas in FIG. 6 it is down near to 54% which is an improvement in excess of about 8%. At normal or very close to normal angles of incidence, the increase in transmission is less dramatic because, as pointed out previously, glass at normal angles of incidence transmits approximately 92%.

Thus, it can be seen that the purpose of the high angle anti-reflection coatings is to improve the transmission at high angles so as to increase the light which is coming out of the fixture at high angles where most of the light is needed. This is particularly important where large areas are being lighted as for example, roadways and parking lots. In such situations it is normally desirable to illuminate the large area uniformly. It can be seen that the portions of the area farthest from the lighting fixture receive the light at the highest angle and for this reason, this is where most of the light is desired, that is, at the corners or edges of the zone which is being lighted. As much light as possible is also desired at the high angles because, as is well-known, the intensity of light is diminished by the square of the distance. Therefore, it is desirable to have more light coming from the lighting fixture for those areas which are farthest from the lighting fixture.

Figure 8:
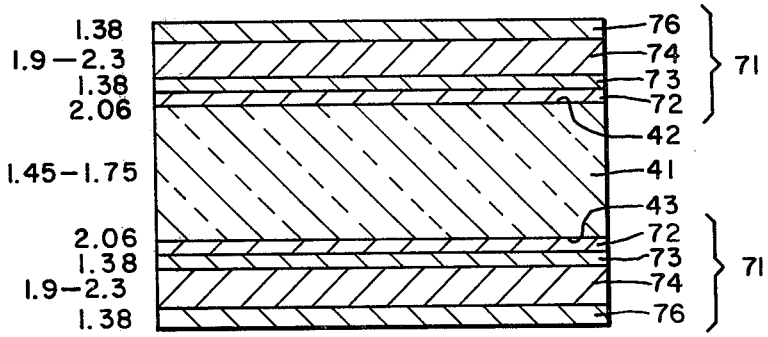
FIG. 8 is a partial cross-sectional view of a glass enclosure having a four-layer high angle anti-reflection coating thereon.

In FIG. 8, there is shown a cross-sectional view of a glass enclosure 41 having a four-layer anti-reflection coating 71 formed on the surfaces 42 and 43 of the enclosure 41. The coating 71 consists of first, second, third, and fourth layers 72, 73, 74 and 76 respectively, counting from the substrate. The four-layer coating is of the general type described in Rock U.S. Pat. No. 3,432,225. As disclosed in the Rock U.S. Pat. No. 3,432,225, the first and second layers are utilized to synthesize the desired index refraction and have combined thickness of approximately one-quarter wave, whereas the third-layer has a half-wave optical thickness and the fourth-layer 76 has a quarter wave optical thickness at the design wave-length of 550 nanometers which is the center of the visual region. In order to attain higher transmission at high angles of incidence, the thicknesses of the layers 72, 73, 74 and 76 have been varied from that disclosed in the Rock patent. In the Rock patent, magnesium fluoride and zirconium oxide are materials which are utilized. In connection with the present invention, it has been desired to utilize the magnesium fluoride having an index of refraction of 1.38 and said mixed oxide having an index of refraction of 2.06.

In one embodiment of the invention utilizing a four-layer coating, the first-layer 72 had a quarter wave optical thickness of 1340 angstroms; the second-layer had a quarter wave optical wave thickness of 1430 angstroms. The third layer had a quarter wave optical thickness of 9500 angstroms and the fourth-layer had a quarter wave optical thickness of 6500 angstroms. Only two materials magnesium fluoride and the aforementioned mixed oxide were used with said mixed oxide being used in the first and third layers and magnesium fluoride being utilized in the second and fourth layers. In comparison to the design utilized in the Rock U.S. Pat. No. 3,432,225 the first and second layers are increased slightly in thickness, the third layer is decreased slightly in thickness and the fourth layer is increased in thickness.

Two additional specific four-layer anti-reflection coating designs are as follows. One of the two additional four layer designs, the first layer 72 is formed of titanium dioxide ($TiO_2$) having an index of refraction of 2.31 and having an optical thickness of 1,130 angstroms. The second layer 73 was formed of silicon dioxide ($SiO_2$) having an index of refraction of 1.45 and an optical thickness of 1,690 angstroms. The third layer 74 was formed of titanium dioxide ($TiO_2$) having an index of refraction of 2.31 and having an optical thickness of 9,570 angstroms. The fourth layer 76 was formed of silicon dioxide ($SiO_2$) and having an index of refraction of 1.45 and an optical thickness of 6,270. In the second of the additional four-layer designs, the first layer 72 was formed of zirconium oxide ($ZrO_2$) having an index of refraction of 2.00 and an optical thickness of 1,390 angstroms. The second layer 72 was formed of magnesium fluoride ($MgF_2$) having an index of refraction of 1.38 and an optical thickness of 1,350 angstroms. The third layer 74 was formed of zirconium dioxide ($ZrO_2$) having an index of refraction of 2.00 and having an optical thickness of 9,270 angstroms. The fourth layer 76 was formed of magnesium fluoride ($MgF_2$) having an index of refraction of 1.38 and an optical thickness of 6,580 angstroms.

Figure 9:
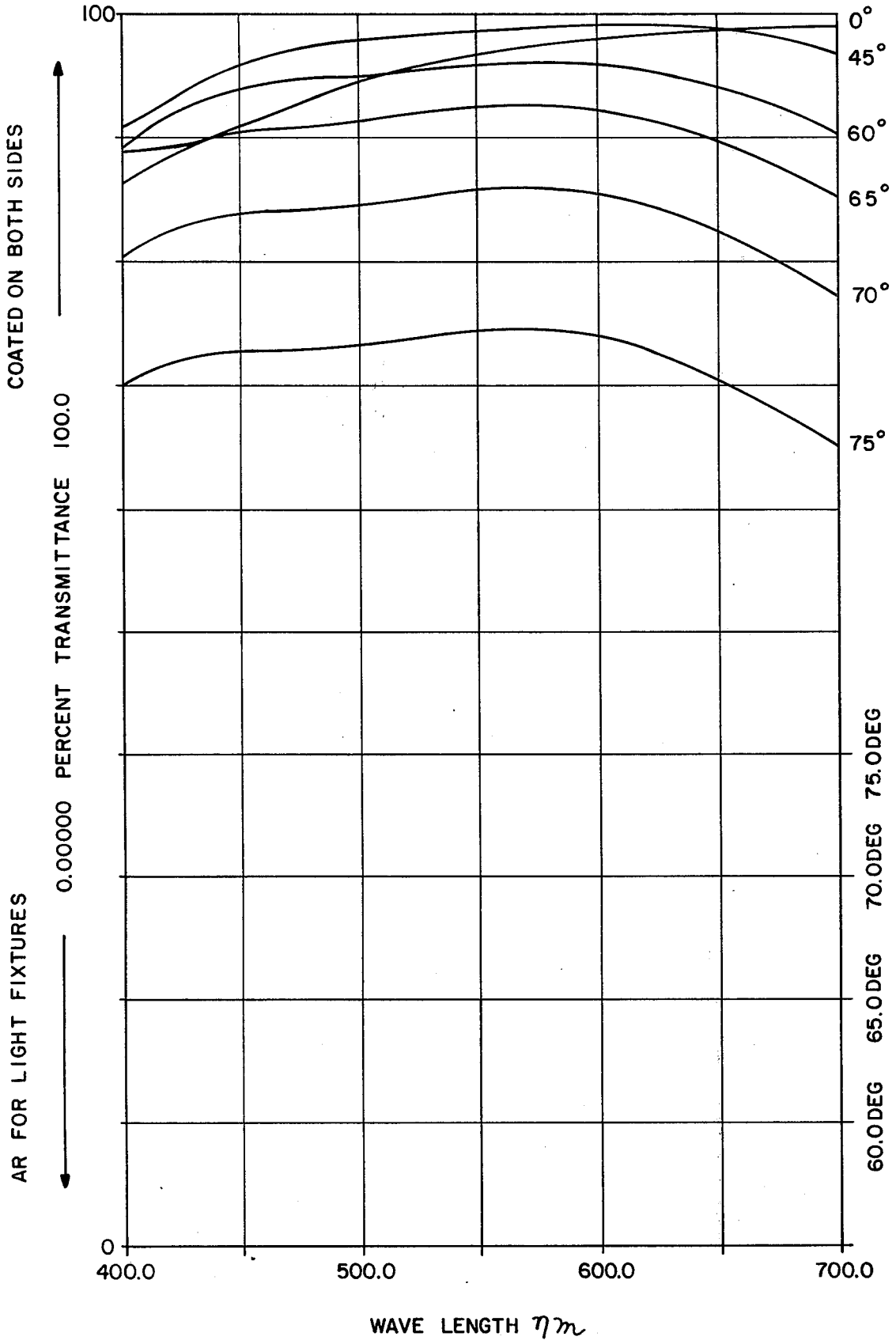
FIG. 9 is a graph showing the transmission with wave-length at different angles for a four-layer high angle anti-reflection coating provided on both sides of the glass enclosure.

In FIG. 9, there is shown a graph of the four-layer anti-reflection coating shown in FIG. 8 optimized for 75° angle of incidence. It has been found that by coating both sides of the glass enclosure for a lighting fixture that the coefficient of utilization is increased by approximately 8%. The coefficient of utilization is that amount of luminous flux which falls on the plane or area which it is desired to light in comparison to the total amount of rated flux for the lamp utilized in the lighting fixture.

In comparing the curves shown in FIG. 9 with those shown in FIG. 7, it can be seen that at the 75° angle of incidence the improvement from FIG. 7 at 62½% to well in excess of 70% again provides approximately 10% improvement.

Figures 10, 11:
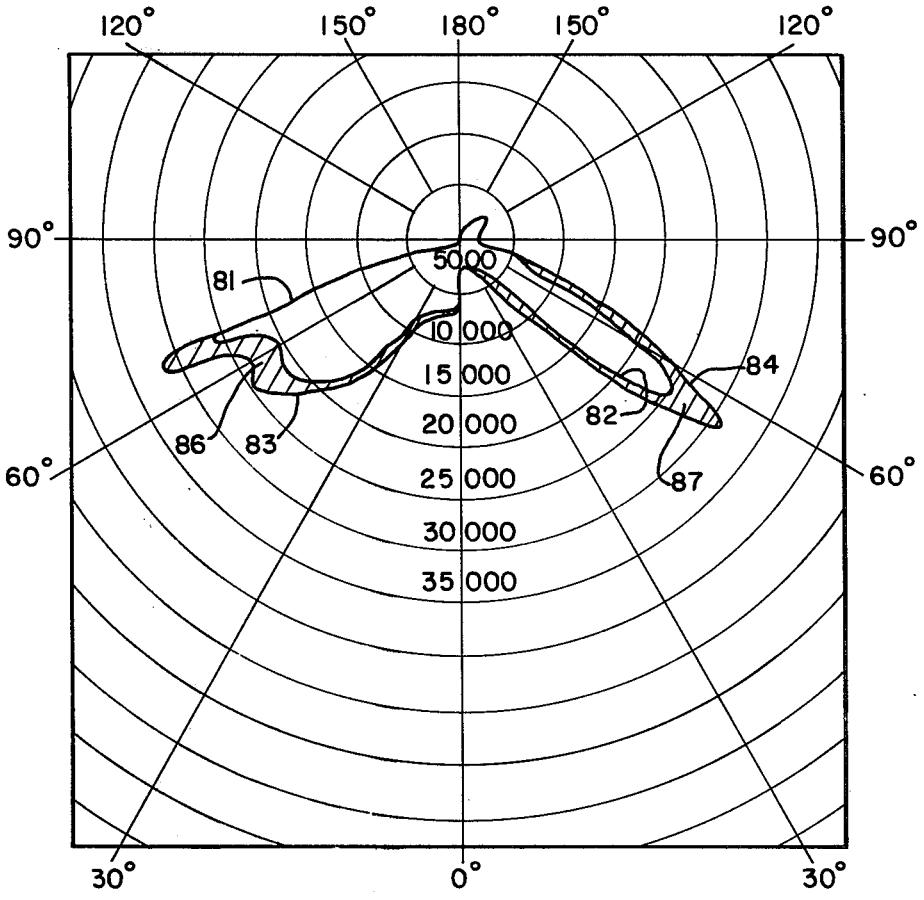
FIG. 10 is a chart showing a comparison of the results utilizing coated and uncoated glass enclosure for a high pressure sodium lamp.
FIG. 11 is a candlepower distribution diagram showing the actual results of tests on a light fixture using a high pressure sodium lamp and showing a comparison between coated and uncoated glass enclosures.

In an actual test of the four-layer high angle anti-reflection coating shown in FIG. 8, it was found that the coefficient of utilization was increased by approximately 8% as can be seen from the chart shown in FIG. 10. As also shown in FIG. 10, the results were obtained on an 18 inch by 18 inch area light using a 400 watt high pressure sodium lamp rated at 50,000 lumens. It can also be seen from FIG. 10 that candlepower change between uncoated and coated glass enclosures change very little at 0°, approximately 0.6% whereas at a vertical angle of 67.5°, the candlepower increase was 20.3% for the coated glass enclosures.

In FIG. 11, there is shown a candlepower distribution diagram for both uncoated glass enclosures and also for glass enclosures coated with the coatings of the present invention. It was found that the maximum candlepower in a vertical plane was at approximately 67.5° as represented by the curve 81. As shown in FIG. 11, it reaches a maximum of approximately 26,000 candlepower. As can be seen from the curve, the candlepower drops off very rapidly at the high angles of incidence but drops off less rapidly at the lower angles and at 0° approaches 6500 candlepower. In the graph shown in FIG. 11, 90° represents the roadside, whereas the 180° represents the house or field side of the lighting fixture. In other words, the 0° line would be a line perpendicular to the line of traffic on the road.

The right-hand side of the plot shown in FIG. 11 is the candlepower and maximum cone with the cone being one defined by a circle travelling through the maximum candlepower of 67.5° and going up to the source of light which would define a cone extending through 360° around the light. The candlepower measurements are those which are made in a cone generated in this fashion. The candlepower is independent of distance and therefore it does not make any difference where the measurements are made in the cone insofaras the distance from the light is involved. The curve for uncoated glass is curve 82. It can be seen that the candlepower is a maximum at approximately 57° at approximately 26,000 candlepower. This maximum would be in a region half-way between the sidewalk and the street which is a very desirable area because this would be the maximum distance from the lighting fixture.

Plots similar to the plots which are utilized to form the curves 81 and 82 for uncoated glass were performed for the coated glass with a four-layer anti-reflection coating provided on each surface of the glass enclosure. The candlepower in a maximum plane is represented by the curve 83 whereas the candlepower in the maximum cone is represented by the curve 84 in FIG. 11. The shaded areas 86 and 87 between the curves 81 and 83 and 82 and 84 respectively represent the improvement provided by the coatings. As can be seen from the curves in the maximum plane, the improvement at the higher angles is quite significant in the amount of candlepower, whereas at the smaller angles of incidence it drops off quite rapidly. From the curves in the maximum cone, it can be seen that there is substantially greater candlepower provided at the desired angle of approximately 55° with the improvement dropping off sharply at higher and lower angles on each side.

Figure 12:
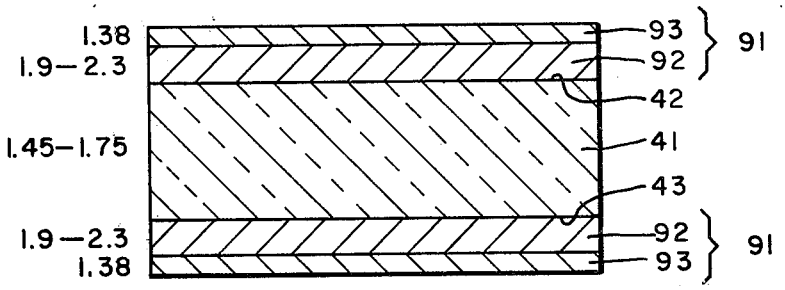
FIG. 12 is a partial cross-sectional view of a glass enclosure in which a two-layer high angle anti-reflection coating is provided on both surfaces.

In FIG. 12 the substrate 41 is shown with two-layer anti-reflection coatings 91 provided on each of the surfaces 42 and 43. It consists of first and second layers 92 and 93 counting from the substrate. It is also designed for high efficiency at high angles. In one design the first layer 92 was formed of said aforementioned mixed oxide having an index of refraction of 2.06 and having a quarter wave optical thickness of 10,000 angstroms. The layer 93 was formed of magnesium fluoride having an index of refraction of 1.38 and having a quarter wave optical thickness of 6500 angstroms. These thicknesses can be varied by plus or minus 15% and still achieve satisfactory results.

Two additional designs of the two-layer anti-reflection coating had the following parameters. The first layer 92 was formed of titanium dioxide ($TiO_2$) having an index of refraction of 2.31 and an optical thickness of 9,840 angstroms. The second layer was formed of silicon dioxide ($SiO_2$) having an index of refraction of 1.45 and an optical thickness of 6,330 angstroms. In the second design, the first layer 92 was formed of zirconium dioxide ($ZrO_2$) having an index of refraction of 2.00 and an optical thickness of 9,930 angstroms. The second layer 93 was formed of magnesium fluoride ($MgF_2$) having an index of refraction of 1.38 and having an optical thickness of 6,650 angstroms.

Figure 13:
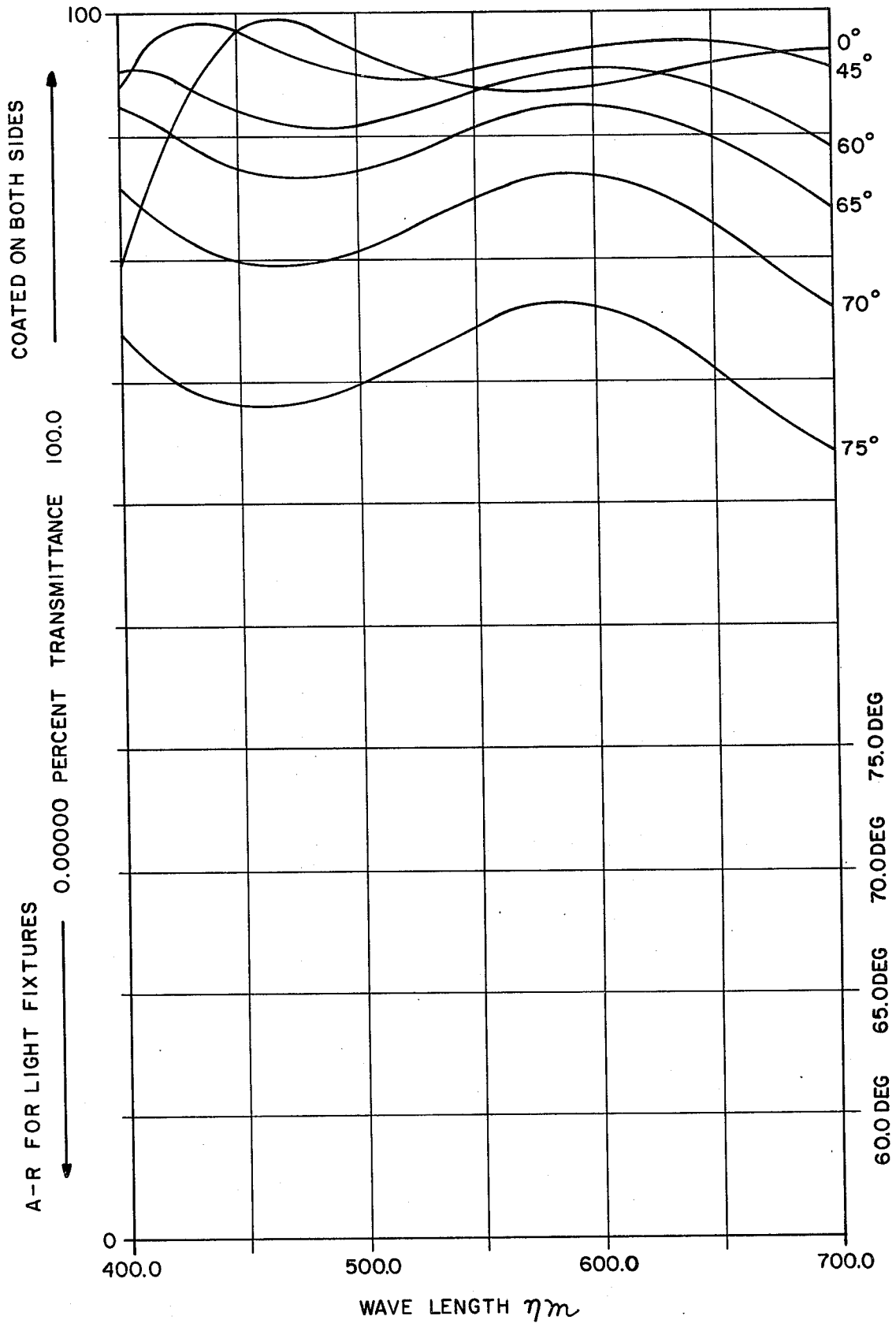
FIG. 13 is a graph showing the transmission with wave-length at different angles of the two-layer high angle anti-reflection coatings shown in FIG. 12 provided on both surfaces of the glass enclosure.

A plot of the transmission characteristics of the glass enclosure carrying the two-layer anti-reflection coatings of the type shown in FIG. 12 is shown in FIG. 13. As can be seen from FIG. 13, the two-layer anti-reflection coatings are effective over a shorter wave length range. Therefore, it is desirable to utilize such two-layer anti-reflection coatings with lamps which have a relatively narrow wave band. In such a situation, the two-layer anti-reflection coating would be more desirable because it is less expensive to manufacture. For example, it can find ready application in light fixtures which utilize high pressure or low pressure sodium lamps.

As can be seen from FIG. 13, this coating is most efficient at approximately 590 nanometers. This is the area of emission of high pressure sodium lamps and also low pressure sodium lamps. Although the two-layer anti-reflection coating can be utilized with other lamps, as for example, mercury or metal halide lamps, the coating would be less efficient than the three-layer or four-layer anti-reflections hereinbefore disclosed. In comparing the curves in FIGS. 7 and 13 it can be seen that there is a marked improvement in transmission at 590 nanometers, as for example, from approximately 61% to 76% to give an improvement of approximately 15% in additional transmission.

Figure 14:
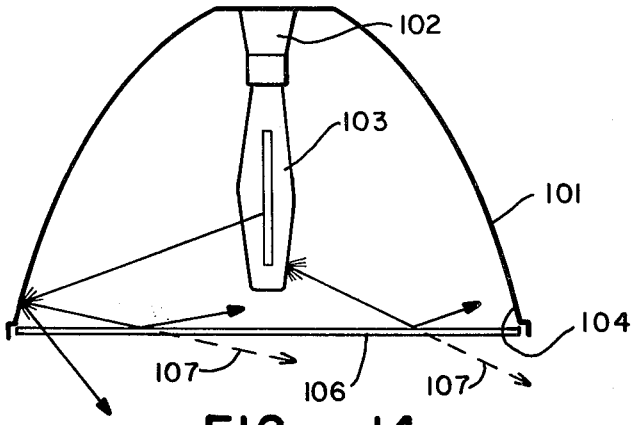
FIG. 14 is a schematic view of a light fixture having a glass enclosure in which a coating has been provided thereon to reduce glare.

In FIG. 14, there is shown another lighting fixture or luminaire having a housing 101 which is generally hemispherical and which carries a socket 102 having a lamp 103 therein. The housing is provided with a circular downwardly facing opening 104 which is normally closed by a glass enclosure or plate 106. With this type of lighting fixture there is a tendency for light to be emitted therefrom at very high angles as represented by the rays 107. Such angle rays tend to produce glare. It will be noted that these high angle rays 107 are represented by the broken lines.

Figure 15:
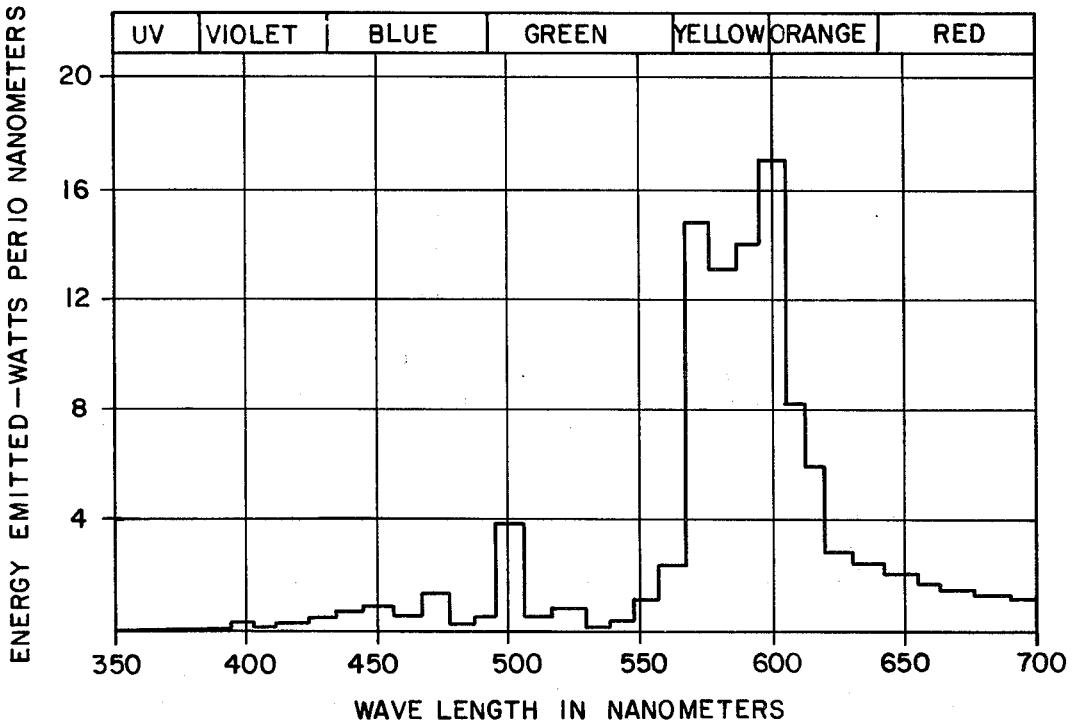
FIG. 15 is a graph showing the distribution pattern by wave-length from a conventional high pressure sodium lamp.

In FIG. 15, there is shown the distribution pattern by wave-length of the light created by a high pressure sodium lamp. It can be seen that most of the light is emitted between 500 and 650 nanometers.

The glass enclosure 106 is also provided with planar or parallel surfaces 111 and 112 which have provided thereon six-layer anti-reflection coatings 113. The coating 113 is provided with first, second, third, fourth, fifth and sixth layers 114, 116, 117, 118, 119 and 121 respectively counting from the substrate. It is made up of alternate layers of high and low index materials. In one embodiment of the present invention, the high index material was said aforementioned mixed oxide having an index of refraction of 2.06 and the low index material was magnesium fluoride having an index of 1.38. The first layer 114 was formed of said aforementioned mixed oxide having a quarter wave optical thickness of 9,600 angstroms, the second layer was formed of magnesium fluoride and having a quarter wave optical thickness of 8,450 angstroms. The third layer was formed of said aforementioned mixed oxide having a quarter wave optical thickness of 8,450 angstroms, the fourth layer was formed of magnesium fluoride having a quarter wave optical thickness of 8,450 angstroms, the fifth layer was formed of said aforementioned mixed oxide having a quarter wave optical thickness of 8,450 angstroms and the sixth and last layer was formed of magnesium fluoride having a quarter wave optical thickness of 4,320 angstroms. The thicknesses of these layers can be varied plus or minus 15%. In addition, if it is desired, other materials can be utilized.

Two additional six-layer designs had the following specific parameters. In the first additional embodiment the first, third and fifth layers 114, 117 and 119 were formed of titanium dioxide ($TiO_2$) having an index of refraction of 2.31 and having optical thicknesses of 9,600 angstroms, 8,450 angstroms and 8,450 angstroms respectively. The second, fourth and sixth layers 116, 118, and 121 were formed of silicon dioxide ($SiO_2$) having an index of refraction of 1.45 and having optical thicknesses of 8,450 angstroms, 8,450 angstroms and 4,320 angstroms respectively. In the second of the additional six-layer designs, the first, third and fifth layers were formed of zirconium dioxide ($ZrO_2$) having an index of refraction of 2.00 and having optical thicknesses of 9,600 angstroms, 8,450 angstroms and 8,450 angstroms respectively. The second, fourth and sixth layers were formed of magnesium fluoride having an index of refraction of 1.38 and having optical thicknesses of 8,450 angstroms, 8,450 angstroms and 4,320 angstroms respectively.

Figure 16:
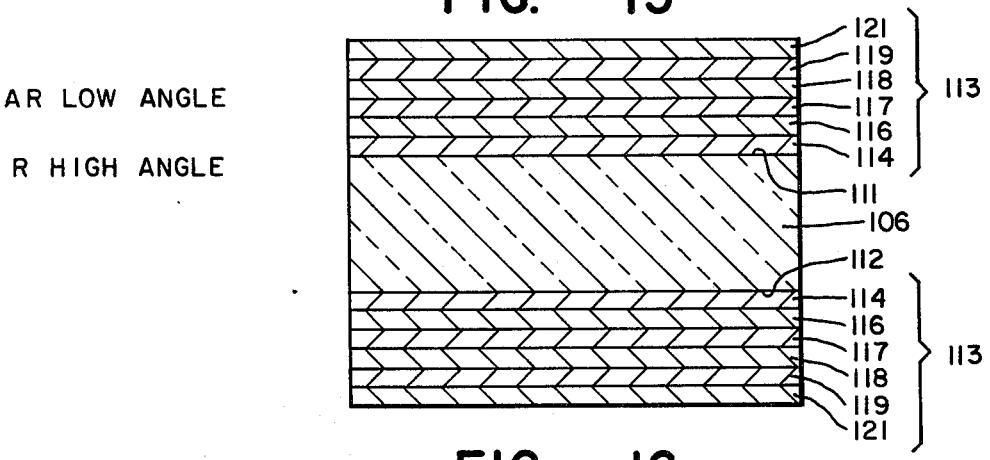
FIG. 16 is a partial cross-sectional view of an enclosure having glare-reducing coating provided on both surfaces of the glass enclosure.
Figure 17:
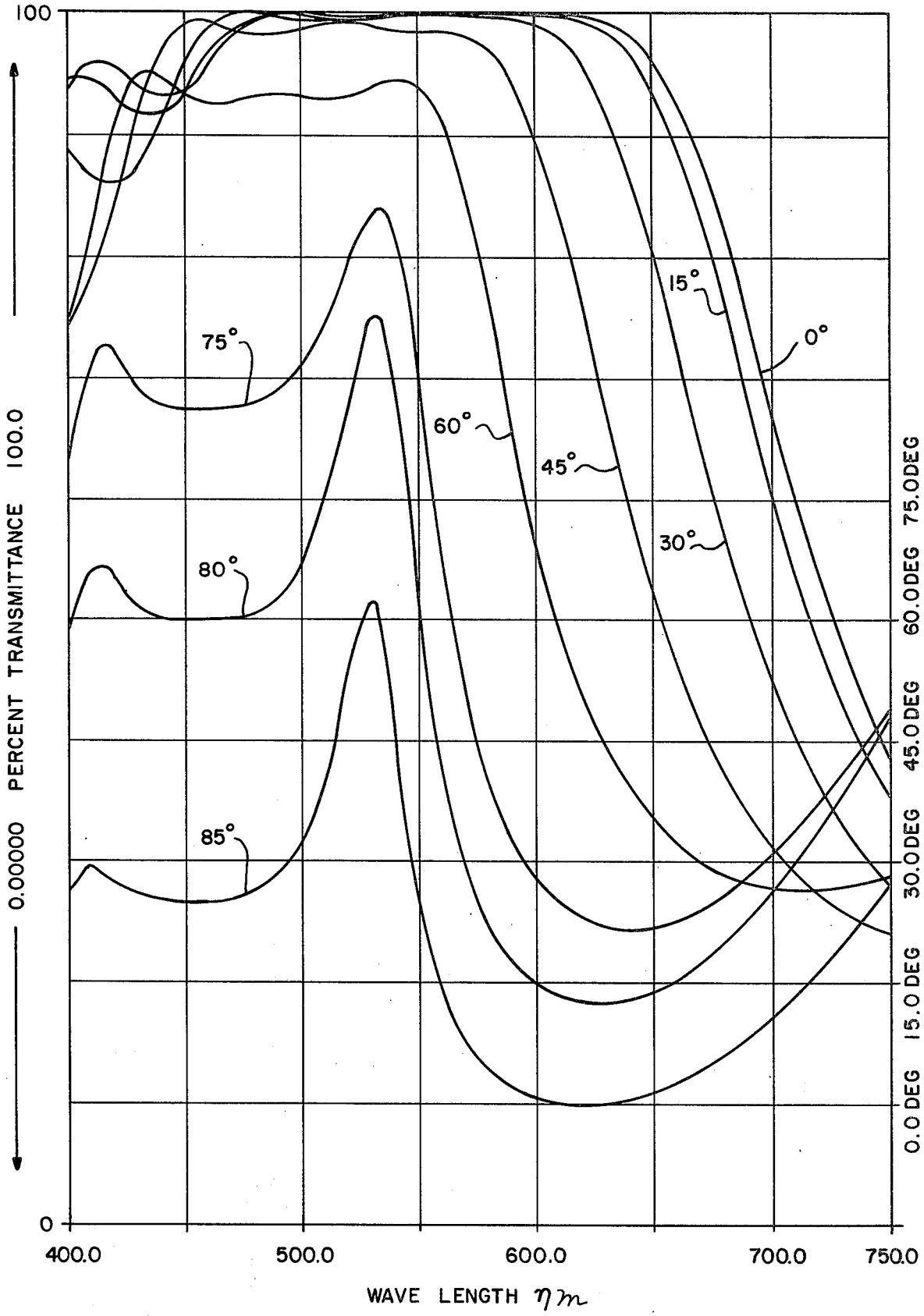
FIG. 17 is a chart showing the transmission with wave-length at different angles for the six-layer glare-reducing coating provided on both surfaces as shown in FIG. 16.

The characteristics of the six-layer coating shown in FIGS. 16 is shown in FIG. 17. FIG. 17 shows curves for various angles. By examining these curves, it can be seen that the six-layer coating provides a short wave pass filter with a very steep cutoff at normal angles. The cutoff commences at approximately 650 nanometers and at 700 nanometers, the transmission is reduced to approximately 60%. However, the remainder of the curves show that the coating serves as anti-reflection coating and provides a very high transmission at the wave lengths below 650 nanometers.

With a high pressure sodium light source having its principal emission around 589 nanometers, it can be seen from FIG. 17 that the six-layer coating would serve as a very effective anti-reflection coating. As the angle of incidence increases, the short-wave cutoff decreases in wavelength. The 50% point at zero angle of incidence is approximately 725 nanometers, at 60° the 50% point is approximately 615 nanometers. When 80° is reached which is an angle of incidence which creates a large amount of glare, the transmission is reduced by approximately 20% to prevent glare from the fixture.

It can be seen from the foregoing that the six-layer coating provided in FIG. 16 makes it possible to increase the transmission or the amount of light which is obtained at low angles of incidence by providing an anti-reflection coating which increases substantially the amount of light that is obtained over that which can be obtained from uncoated glass enclosures. At high angles of incidence the amount of light going through the glass is decreased to reduce the glare from the light fixture. Thus, it can be seen by this coating the glare is reduced while increasing the amount of light in the central area where normally the light would be desired.

It is apparent from the foregoing that there has been provided a number of anti-reflection coatings a number of which have been designed to provide high efficiency at higher angles. One of the coatings has been designed to provide high efficiency at low angles and to reduce transmission at high angles to reduce glare from the fixture. With all the coatings, substantially improved transmission is obtained thereby increasing the total efficiency of the lighting fixture. It should be appreciated that if desired the glass enclosures can be sold separately for use by lighting fixture manufacturers.

What is claimed is:

1. In a lighting fixture, a housing having an open side, a fixture mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said lamp, said high angle being 60° and above from the vertical.

2. A fixture as in claim 1 wherein said glass enclosure is provided with a second surface generally parallel to the first surface together with an additional anti-reflection coating disposed on said second surface and having the same characteristics as the first-named anti-reflection coating.

3. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first and second layers, counting from the substrate, said first layer being formed of a material having an index of refraction of approximately 2.06 and having a quarter wave optical thickness of 10,000 Angstroms plus or minus 15%, the second layer being formed of magnesium fluoride having an index of refraction of 1.38 and having a quarter wave optical thickness of 6,500 Angstroms plus or minus 15%.

4. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second and third layers counting from the substrate, the first layer being formed of a material having an index of refraction ranging from 1.62 to 1.85, the second layer being formed of a material having an index of refraction ranging from 1.9 to 2.3, and the third layer being formed of a material having an index of refraction of 1.38, the first, second and third layers having quarter wave optical thicknesses of 1,650 Angstroms, 11,810 Angstroms and 7,300 Angstroms respectively plus or minus 15%.

5. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second, third and fourth layers counting from the substrate, the first and third layers being formed from a mixed oxide of metals selected from the group consisting of thorium, titanium, copper, tin, chromium, magnesium, iron, nickel, cobalt, cerium, praseodymium, neodymium, samarium, and didymium and having an index of refraction of 2.06 and the second and fourth layers being formed of magnesium fluoride having an index of refraction of 1.38, the first layer having a quarter wave optical thickness of 1,340 Angstroms plus or minus 15%, the second layer having a quarter wave optical thickness of 1,430 Angstroms plus or minus 15%, the third layer having a quarter wave optical thickness fo 9,500 Angstroms plus or minus 15% and the fourth layer having a quarter wave optical thickness of 6,500 Angstroms plus or minus 15%.

6. In a glass enclosure for use with a lighting fixture having an opening therein and a lamp mounted in the housing for producing light rays passing through the opening, a glass substrate having first and second generally parallel surfaces, and an anti-reflection coating carried by at least one of said surfaces, said anti-reflection coating being comprised of a plurality of layers whose thicknesses have been selected for increasing the transmission of the light rays having high angles of incidence of 60° and above from the vertical.

7. In a lighting fixture, a housing having an open side, a lamp mounted in said housing producing light rays passing through the open side, a glass enclosure carried by said housing and enclosing the open side and having at least one surface reflecting light rays at a high angle and an anti-reflection coating disposed on said surface, said anti-reflection coating being comprised of a plurality of layers whose thicknesses have been selected so that said anti-reflection coating has a high efficiency at low angles for increasing transmission of light rays from said fixture and has a reduced efficiency at high angles to reduce the transmission to thereby reduce the glare from the fixture.

8. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first and second layers counting from the substrate, the first layer being formed of titanium dioxide having an index of refraction of 2.31 and an optical thickness of 1,840 Angstroms plus or minus 15%, the second layer being formed of silicon dioxide having an index of refraction of 1.45 and a quarter wave optical thickness of 6,330 Angstroms plus or minus 15%.

9. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first and second layers counting from the substrate, said first layer being formed of zirconium dioxide having an index of refraction of 2.00 and a quarter wave optical thickness of 9,930 Angstroms plus or minus 15%, said second layer being formed of magnesium fluoride having an index of refraction of 1.38 and having a quarter wave optical thickness of 6,650 Angstroms plus or minus 15%.

10. A lighting fixture as in claim 4 wherein the first layer is formed of a material selected from aluminum oxide, cerium oxide and lanthanum oxide, the second layer being formed from a mixed oxide of metals selected from the group consisting of thorium, titanium, copper, tin, chromium, magnesium, iron, nickel, cobalt, cerium, praseodymium, neodymium, samarium, and didymium and zirconium oxide and the third layer being formed of magnesium fluoride.

11. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second and third layers counting from the substrate, the first layer being formed of aluminum oxide having an index of refraction of 1.64 and having a quarter wave optical thickness of 6,430 Angstroms plus or minus 15%, the second layer being formed of titanium oxide having an index of refraction of 2.32 and having a quarter wave optical thickness of 11,440 Angstroms plus or minus 15% and the third layer being formed of magnesium fluoride having an index of refraction of 1.38 and having a quarter wave optical thickness of 7,280 Angstroms plus or minus 15%.

12. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second and third layers counting from the substrate, the first layer being formed of aluminum oxide and having an index of refraction of 1.64 and having a quarter wave optical thickness of 6,427 Angstroms, the second layer being formed of zirconium oxide and having an index of refraction of 2.00 and having a quarter wave optical thickness of 11,870 Angstroms plus or minus 15% and the third layer being formed of magnesium fluoride having an index of refraction of 1.38 and having a quarter wave optical thickness of 7,280 Angstroms plus or minus 15%.

13. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second, third and fourth layers counting from the substrate, the first layer being formed of titanium dioxide having an index of refraction of 2.31 and having a quarter wave optical thickness of 1,130 Angstroms plus or minus 15%, the second layer being formed of silicon dioxide having an index of refraction of 1.45 and a quarter wave optical thickness of 1,690 Angstroms plus or minus 15%, the third layer being formed of titanium dioxide having an index of refraction of 2.31 and having a quarter wave optical thickness of 9,570 Angstroms plus or minus 15% and the fourth layer being formed of silicon dioxide having an index of refraction of 1.45 and having a quarter wave optical thickness of 6,270 Angstroms plus or minus 15%.

14. In a lighting fixture, a housing having an open side, a lamp mounted in said housing and producing light rays passing through the open side, a glass enclosure carried by said housing and enclosing the open side and having at least one surface reflecting light rays at a high angle from the vertical, and an anti-reflection coating disposed on said surface, said anti-reflection coating being comprised of a plurality of layers whose thicknesses have been selected for increasing the transmission of high angle light rays from said fixtures, said high angle being 60° and above from the vertical, said anti-reflection coating having first, second, third and fourth layers counting from the substrate, the first layer being formed of zirconium oxide having an index of refraction of 2.00 and a quarter wave optical thickness of 1,390 Angstroms plus or minus 15%, the second layer being formed of magnesium fluoride having an index of refraction of 1.38 and a quarter wave optical thickness of 1,350 Angstroms plus or minus 15%, the third layer being formed of zirconium dioxide having an index of refraction of 2.00 and a quarter wave optical thickness of 9,270 Angstroms plus or minus 15%, and the fourth layer being formed of magnesium fluoride having an index of refraction of 1.38 and a quarter wave optical thickness of 6,580 Angstroms plus or minus 15%.

15. In a lighting fixture, a housing having an open side, a lamp mounted in said housing producing light rays passing through the open side, a glass enclosure carried by said housing and enclosing the open side and having at least one surface reflecting light rays at a high angle and an anti-reflection coating disposed on said surface, said anti-reflection coating being comprised of a plurality of layers whose thicknesses have been selected so that said anti-reflection coating has a high efficiency at low angles for increasing transmission of light rays from said fixture and has a reduced efficiency at high angles to reduce the transmission to thereby reduce the glare from the fixture, said anti-reflection coating having first, second, third, fourth, fifth and sixth layers counting from the substrate, the first, third and fifth layers being formed of titanium dioxide having an index of refraction of 2.31 and having a quarter wave optical thickness of 9,600 Angstroms, 8,450 Angstroms and 8,450 Angstroms respectively plus or minus 15%, the second, fourth and sixth layers being formed of silicon dioxide having an index of refraction of 1.45 and having quarter wave optical thicknesses of 8,450 Angstroms, 8,450 Angstroms and 4,320 Angstroms respectively plus or minus 15%.

16. In a lighting fixture, a housing having an open side, a lamp mounted in said housing producing light rays passing through the open side, a glass enclosure carried by said housing and enclosing the open side and having at least one surface reflecting light rays at a high angle and an anti-reflection coating disposed on said surface, said anti-reflection coating being comprised of a plurality of layers whose thicknesses have been selected so that said anti-reflection coating has a high efficiency at low angles for increasing transmission of light rays from said fixture and has a reduced efficiency at high angles to reduce the transmission to thereby reduce the glare from the fixture, said anti-reflection coating having first, second, third, fourth and sixth layers counting from the substrate, the first, third and fifth layers being formed of zirconium dioxide and having an index of refraction of 2.00 and having an optical thickness of 9,600 Angstroms, 8,450 Angstroms and 8,450 Angstroms respectively plus or minus 15%, the second, fourth and sixth layers being formed of magnesium fluoride and having an index of refraction of 1.38 and having quarter wave optical thicknesses of 8,450 Angstroms, 8,450 Angstroms and 4,320 Angstroms respectively plus or minus 15%.

17. A lighting fixture as in claim 7 wherein the anti-reflection coating has a characteristic in that when the angle of incidence approaches 80°, the transmission is reduced by approximately 20% to minimize glare from the fixture.

18. A lighting fixture as in claim 17 wherein the anti-reflection coating serves as a short wave pass filter with a very steep cut-off at normal angles in which the cut-off commences at approximately 650 nanometers to 700 nanometers and in which the transmission is reduced to approximately 60% and wherein the anti-reflection coating provides a very high transmission at wave lengths below 650 nanometers.

19. A lighting fixture as in claim 18 wherein said light source is a high pressure sodium light source having its principal emission around 589 nanometers.

20. In a glass enclosure for use with a lighting fixture having an opening therein and a lamp mounted in the housing for producing light rays passing through the opening, a glass substrate having first and second generally parallel surfaces and an anti-reflection coating carried by at least one of said surfaces, said anti-reflection coating being comprised of a plurality of layers whose thicknesses have been selected to provide high efficiency and increased transmission at low angles and to provide reduced transmission at high angles to thereby reduce the glare from the fixture.

21. In a glass enclosure for use with a lighting fixture having an opening therein and a lamp mounted in the housing for producing light rays passing through the opening, a glass substrate having first and second generally parallel surfaces and an anti-reflection coating carried by at least one of said surfaces, said anti-reflection coating being comprised of a plurality of layers whose thicknesses have been selected to provide high efficiency and increased transmission at low angles and to provide reduced transmission at high angles to thereby reduce the glare from the fixture, said anti-reflection coating serving s a short wave pass filter with a steep cut-off at substantially normal angles.

22. An enclosure as in claim 21 wherein the cut-off commences at approximately 650 to 700 nanometers.

* * * * *